United States Patent [19]

Sumikawa et al.

[11] Patent Number: 4,580,950

[45] Date of Patent: Apr. 8, 1986

[54] SLIDING-VANE ROTARY COMPRESSOR FOR AUTOMOTIVE AIR CONDITIONER

[75] Inventors: Seiji Sumikawa; Kagehisa Kato, both of Konan, Japan

[73] Assignee: Diesel Kiki Co., Ltd., Tokyo, Japan

[21] Appl. No.: 725,203

[22] Filed: Apr. 19, 1985

[30] Foreign Application Priority Data

Apr. 25, 1984 [JP] Japan ..... 59-61191[U]

[51] Int. Cl.[4] ..... F04B 49/02

[52] U.S. Cl. ..... 417/295

[58] Field of Search ..... 417/295, 298, 310; 137/491, DIG. 8

[56] References Cited

U.S. PATENT DOCUMENTS 3,264,842 8/1966 Dobbie ..... 417/295

3,994,358 11/1976 Smitley ..... 417/295 X

FOREIGN PATENT DOCUMENTS 57-91394 6/1982 Japan ..... 417/295

*Primary Examiner*—Richard E. Gluck

*Attorney, Agent, or Firm*—Wenderoth, Lind & Ponack

[57] ABSTRACT

A sliding-vane rotary compressor includes an intake pressure control valve disposed within a cylinder head of the compressor and located between an intake passage for a fluid to be compressed and a low pressure chamber. The control valve comprises a pressure responsive element such as a vacuum bellows or diaphragm actuatable in response to either the pressure in the intake passage or the pressure in the low pressure chamber, a pilot valve connected to the pressure responsive element, a pilot passage adapted to be opened and closed by the pilot valve for developing a difference in pressure, a main or differential piston movable in response to the pressure difference developed, and a throttle mechanism responsive to the movement of the piston for varying the area of an orifice through which the intake passage communicates with the low pressure chamber. The control valve thus constructed is actuatable in immediate response to a change in pressure of a fluid to be compressed and creates a valve-activating force strong enough to reduce the flow of the fluid when the engine r.p.m. is high.

7 Claims, 4 Drawing Figures

SLIDING-VANE ROTARY COMPRESSOR FOR AUTOMOTIVE AIR CONDITIONER

BACKGROUND OF THE INVENTION

1. Field of the Invention:

The present invention relates to sliding-vane rotary compressors, and more particularly to a sliding-vane rotary compressor having a variable capacity which is suitable for use in an automotive air conditioning system.

2. Related Art:

Sliding-vane rotary compressors are known in which vanes are slidably carried in radial slots in a rotor disposed in a bore of a cylinder and, as the rotor is rotated by an automotive engine, they slide on the inner wall of the bore to compress a fluid trapped between adjacent vanes. An advantage of the sliding-vane rotary compressors over the reciprocating compressors lies in a high volumetric efficiency. However, the rotary compressors is disadvantageous in that the volumetric efficiency increases with an increase in engine r.p.m., while the refrigerating capacity drops slightly. Because of such peculiar properties, the rotary compressors perform a large displacement volume operation when the engine r.p.m. is high. This operation would cause various difficulties such as, for example, an undue increase in pressure of the discharged refrigerant gas, an uncomfortable room condition due to temperature fluctuation of fresh air caused by a repeated activation and de-activation of an electromagnetic clutch, and a notable power loss due to imbalance in capacity between the compressor, an evaporator and a condenser in an air conditioning system.

Japanese Patent Laid-open Publication No. 57-91394 discloses one prior attempt taken to overcome the foregoing difficulties, wherein an intake pressure control valve is provided for adjusting the capacity of a sliding-vane rotary compressor. The control valve is actuatable in response to the pressure in a low pressure chamber in the compressor so as to reduce the flow of a refrigerant gas when the pressure of the refrigerant gas drops below a predetermined value, thereby enabling the compressor to operate at a reduced displacement volume. According to the disclosed arrangement, the control valve includes a valve body disposed in a bore extending in a compressor body perpendicularly to an intake opening through which a compression chamber, while in the intake stage, communicates with the low pressure chamber. The valve body is biased by a spring and adapted to move into and out of an intake passage to directly control the pressure in the intake passage. The control valve thus constructed is however unable to create a valve-activating force strong enough to move the valve body for throttling the flow of the refrigerant gas. Another drawback is in that the control valve is less responsive to the pressure change and hence difficult to control with accuracy.

SUMMARY OF THE INVENTION

It is therefore an object of the present invention to provide a sliding-vane rotary compressor capable of eliminating the foregoing difficulties of the prior art.

A more specific object of the present invention is to provide a sliding-vane rotary compressor in which an intake pressure control valve creates a valve-activating force strong enough to throttle the flow of a refrigerant gas when the engine r.p.m. is high.

Another object of the present invention is to provide a sliding-vane rotary compressor having an intake pressure control valve actuatable in immediate response to a change in pressure of a fluid to be compressed.

According to the present invention, a sliding-vane rotary compressor comprises an intake pressure control valve disposed within a cylinder head and located between an intake passage for a fluid to be compresed and a low pressure chamber, the control valve including a pressure responsive element actuatable in response to either the pressure in the intake passage or the pressure in the low pressure chamber, a pilot valve connected to the pressure responsive element, a pilot passage adapted to be opened and closed by the pilot valve, a main or differential piston movable in response to a difference in pressure developed by opening and closing of the pilot passage, and a throttle mechanism responsive to the movement of the piston for varying the area of an orifice through which the intake passage communicates with the low pressure chamber.

With the compressor thus constructed, when the pressure in the intake passage or the pressure in the low pressure chamber drops, the pressure responsive element immediately responds to such pressure drop and displaces the pilot valve to close or open the pilot passage, developing a difference in pressure. The main piston is displaced in proportion with the pressure difference thus developed to throttle the orifice, thereby enabling the throttle mechanism to perform a reliable throttling action. Thus, the foregoing drawbacks of the prior art can be eliminated.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
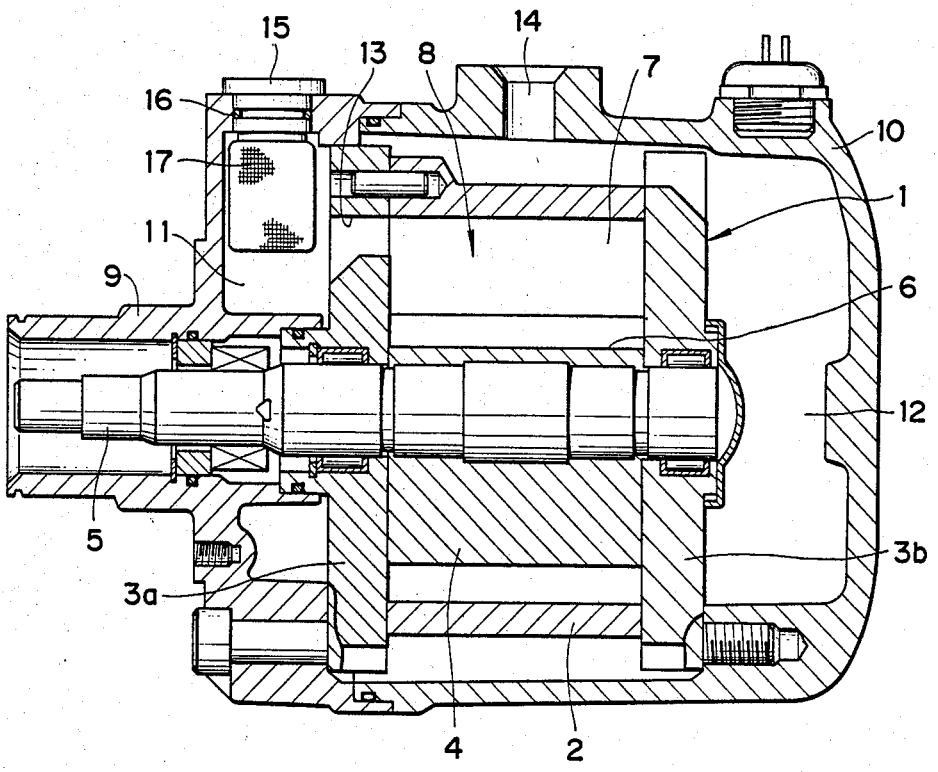
FIG. 1 is a cross-sectional view of a sliding-vane rotary compressor according to the present invention.

Referring now to the drawing, wherein like reference characters designate identical or corresponding parts throughout several views, and more particularly to FIG. 1, there is shown a sliding-vane rotary compressor which comprises a compressor body 1 including a cylinder 2 having an elliptical bore, a pair of front and rear side blocks 3*a*, 3*b* fixedly mounted one on each side of the cylinder 2, and a cylindrical rotor 4 rotatably mounted in the bore of the cylinder 2. The rotor 4 is secured to a drive shaft 5 for co-rotation therewith, the drive shaft 5 being journaled on the front and rear side blocks 3*a*, 3*b*. The rotor 4 has a plurality of radial slots 6 in which vanes 7 are slidably disposed. The vanes 7 are urged into sealing engagement with the inner wall of the elliptical bore so that compression chambers 8 are defined between the compressor body 1 and the rotor 4 in conjunction with adjacent vanes 7. Due to the elliptical configuration of the bore, the compression chambers 8 change in volume as the rotor 4 and the vanes 7 rotate in the elliptical bore as an integral unit.

The compressor body 1 is fixedly mounted inside a housing which is composed of a cylinder head 9 on the front side and a shell 10 on the rear side, there being defined a low pressure chamber 11 between the cylinder head 7 and the compressor body 1, and a high pressure chamber 12 between the compressor body 1 and the shell 10. The front side block 3*a* has a pair of intake openings 13 (only one shown) through which the low pressure chamber 11 is held in fluid communication with two compression chambers 8 while the latter is in the intake stage. Thus, a fluid to be compressed, for example refrigerant gas in an automotive air conditioning system, is sucked from the lower pressure chamber 11 into the compression chambers 8. The cylinder 2 has a pair of discharge ports (not shown) formed near the upper dead points of the rotor 4 and normally closed by check valves (not shown). The compression chambers 8, while in the discharge stage or in communication with the respective discharge ports, urge the refrigerant gas to open the check valves and then to flow from the compression chambers 8 into the high pressure chamber 12 at elevated pressure. The high pressure chamber 12 communicates with an outlet passage 14 extending through the shell 10 for discharging the compressed refrigerant gas outside the sliding-vane rotary compressor.

An intake joint or connector 15 is sealingly mounted on an upper portion of the cylinder head 9 with an O-ring 16 interposed therebetween. The lower portion of the intake connector 15 is disposed in the low pressure chamber 11 and covered with a strainer 17 within which an intake pressure control valve is disposed as described below in detail.

Figure 2:
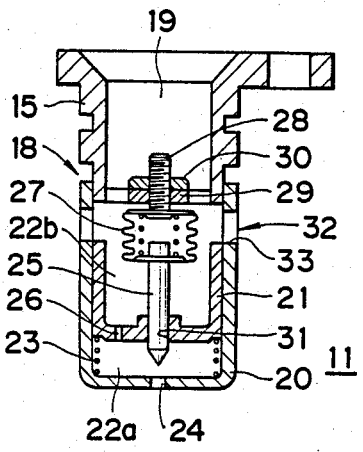
FIG. 2 is a cross-sectional view of an intake pressure control valve associated with the compressor shown in FIG. 1, the valve being shown in the open position.
Figure 3:
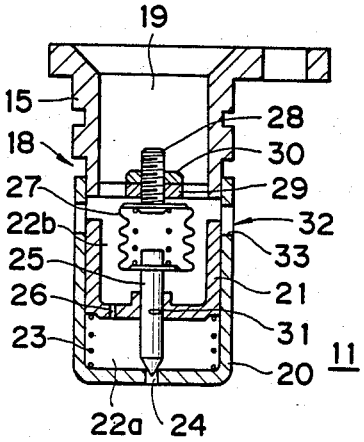
FIG. 3 is a view similar to FIG. 2, showing the valve in the closed position.

As shown in FIGS. 2 and 3, the intake pressure control valve generally indicated by the numeral 18 is of the pilot type and disposed between a refrigerant intake passage 19 defined in the intake connector 15 and the low pressure chamber 11. The intake pressure control valve 18 includes a cup-like casing 20 firm1y fitted over the lower portion of the intake connector 15, and a cup-like main or differential piston 21 slidably disposed in the casing 20, the piston 21 separating the interior of the casing 20 into a lower valve chamber 22*a* and an upper valve chamber 22*b*. A compression coil spring 23 is disposed in the lower valve chamber 22*a* and acts between the casing 20 and the main piston 21 to urge the latter upward. The casing 21 has a pilot passage 24 formed centrally in the bottom wall of the casing 21 for bringing the low pressure chamber 11 into fluid communication with the lower valve chamber 22*a* when a pilot valve 25 is located remote from the pilot passage 24. The upper and lower valve chambers 22*a*, 22*b* are held in permanent communication with each other through a throttle or compensating passage 26 extending through the bottom wall of the main piston 21. A pressure responsive element 27 is disposed in the upper valve chamber 22*b* and displacable in response to a change in circumferential pressure. In the illustrated embodiment, the pressure responsive element comprises a vacuum bellows assembly 27 which contracts as the circumferential pressure increases and extends as the circumferential pressure decreases. The pilot valve 25 is connected to the lower end of the bellows 27 and extends axially downwardly therefrom, while an adjustment screw 28 is connected to the upper end of the bellows 27 and extends axially upwardly therefrom in alignment with the pilot valve 25. The adjustment screw 28 is threaded through a horizontal support plate 29 secured to the intake connector 15. A nut 30 is threaded on the adjustment screw 28 to lock the latter in position on the support plate 29. Thus, the pressure responsive element or the bellows 27 is positionally adjustable in an axial direction while the nut 30 is loosened. The pilot valve 25 is sealingly fitted in a central guide hole 31 provided in the bottom wall of the main piston 20 and it is vertically reciprocable to close and open the pilot passage 24 in response to the axial displacement of the bellows 27. The main piston 21 and the casing 20 jointly form a throttle mechanism 32 which includes a plurality of radial orifices 33 formed in the peripheral wall of the casing 20, and an upper circular edge of the main piston 21 adapted to vary the area of the orifices 33 in response to the vertical movement of the main piston 21 with respect to the casing 20. Although not shown, a check valve is disposed in the intake passage 19 upstream of the intake pressure control valve 18.

Stated more specifically, when the pressure in the refrigerant intake passage 19 is higher than a predetermined value, for instance 1.4 $Kg/cm^2G$, the bellows 27 contracts to move the pilot valve 25 upwardly away from the pilot passage 24, as shown in FIG. 2, thus allowing the refrigerant gas to escape from the lower valve chamber 22*a* through the pilot passage 24 into the low pressure chamber 11. This refrigerant gas escape keeps the pressure in the lower valve chamber 22*a* below the pressure in the upper valve chamber 22*b*. Thus, a difference in pressure is developed between the upper and lower valve chambers 22*b*, 22*a*, urging the main piston 21 downwardly against the bias of the spring 23 to fully open the orifices 33. When the pressure in the intake passage 19 drops below the predetermined value, the bellows 27 extends to move the pilot valve 25 downwardly, thereby closing the pilot passage 24, as shown in FIG. 3. Due to the permanent communication between the upper and lower valve chambers 22*b*, 22*a* through the throttle passage 26, the pressure in the lower valve chamber 22*a* gradually approaches the pressure in the upper pressure chamber 22*b*, whereupon the main piston 21 is moved upwardly by the force of the spring to thereby throttle the orifices 23.

The sliding-vane rotary compressor thus constructed operates as follows: The shaft 5 is driven by an automotive engine, not shown, to rotate about its own axis whereupon the rotor 4 and accordingly the vanes 7 rotate in the cylinder 2 while being held in sealing engagement with the inner wall of the elliptical bore in the cylinder 2. When the compression chambers 8 are in communication with the low pressure chamber 11, the refrigerant gas is sucked from the intake passage 19 into the compression chambers 8 successively through the check valve, the low pressure chamber 11 and the intake openings 13 (intake stage). Further rotation of the rotor 4 reduces the volume of the compression chambers 8 to thereby compress the refrigerant gas trapped therein (compression stage). When the rotor 4 passes the unshown discharge ports, the refrigerant gas is discharged from the compression chambers 8 through the discharge ports and the unshown check valves to the high pressure chamber 12, thence through the outlet passage to the condenser not shown (discharge stage).

While the engine r.p.m. is not so high, or moderate, the pressure in the refrigerant intake passage 19 is kept above the predetermined value. During that time the pressure responsive element or the bellows 27 contracts to fully open the orifices 33, thereby providing the maximum opening area which assumes a condition free of the intake pressure control valve 18. Thus, the compressor operates substantially at full capacity.

When thc pressure in the refrigerant intake passage 19 drops below the predetermined value as the engine r.p.m. increases, the bellows 27 extends to the position of FIG. 3 to throttle the orifices 33, thereby reducing the flow of the refrigerant gas from the intake passage 19 to the low pressure chamber 11. This throttle action causes a reduction in quantity of the refrigerant gas sucked into the compression chambers 8. Accordingly, the compressor operates at reduced volumetric efficiency and displacement volume and hence becomes small in capacity.

Figure 4:
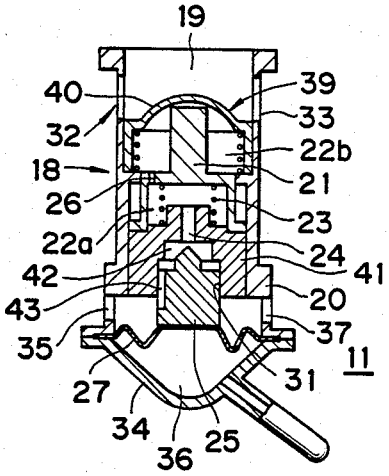
FIG. 4 is a cross-sectional view of a modified form of the intake pressure control valve according to the present invention.

FIG. 4 shows a modified form of the intake pressure control valve 18 according to the present invention. The modified control valve includes a pressure responsive element in the form of a diaphragm 27. The diaphragm 27 has a peripheral edge portion sandwiched between the casing 20 and a bottom cover 34 so as to define therebetween an upper valve chamber 35 and a lower reference pressure chamber 36. The valve chamber 35 communicates with the low pressure chamber 11 via openings 37 formed in the casing 20. The reference pressure chamber 36 is substantially defined in the bottom cover 34 and contains a gas such as nitrogen gas for detecting the pressure in the low pressure chamber 11. The pressure in the reference pressure chamber 36 thus constructed varies in response to a change in pressure of the low pressure chamber 11. The main or differential piston 21 has an upper end held in abutting engagement with a dome-shaped valve body 40 of a check valve 39, the lower end of the main piston 21 being seated on a support block 41 integral with the casing member 20, the casing member 20 and support block 41 together defining a cup-like casing having a peripheral flange extending away from the open opposite end of the casing which defines the intake passage 19. The check valve 39 serves to prevent the reverse flow of the refrigerant gas from the low pressure chamber 11 to the intake passage 19. In the illustrated embodiment, the throttle mechanism 32 is composed of the orifices 33 and the valve body 40 which is movable to partly close the orifices to thereby reduce or restrict the flow of the refrigerant gas to be drawn into chamber 11 for subsequent compression in compression chamber 8. In operation, when the pressure in the low pressure chamber 11 is higher than the pressure in the reference pressure chamber 36, the diaphragm 27 flexes downwardly to lower the pilot valve 25, thereby opening the pilot passage 24, as shown in FIG. 4. Thus, the refrigerant gas is allowed to escape from the lower valve chamber **22*a* to the low pressure chamber 11 successively through the pilot passage 24, a passage 42 defined between the pilot valve 25 and the support block 41, a vertical groove 43 formed in the pilot valve 25, and the valve chamber 35. In this condition, the main piston 21 is brought into abutting engagement with the support block 41 against the bias of the compression coil spring 23 with the result that the valve body 41 is lowered under the pressure of the refrigerant gas to thereby fully open the orifices 33. When the pressure in the low pressure chamber 11 drops below the pressure in the reference pressure chamber 36, the diaphragm 27 flexes upwardly to lift the pilot valve 25 into sealing engagement with the pilot passage 24. This causes a reduction in the pressure difference between the valve chambers 22*a*, 22*b* whereupon the main piston 21 is moved upwardly by the force of the spring 23 to thereby lift the valve body 40, reducing the opening area of the orifices 33. Obviously, the control valve according to this embodiment achieves the same function and effect as those achieved by the control valve according to the first embodiment. The control valve of the second embodiment is advantageous over the control valve of the first embodiment in that the pressure in the low pressure chamber 11 can be detected via the openings 37 for compensation which provides an accurate control of the intake pressure. Since the pilot passage is opened when the control valve 18 is damaged due to a broken diaphragm, for example, the orifices 33** are kept open. Thus, a lubricating oil contained in the refrigerant gas can be returned to the inside of the compressor, thereby preventing a seizure of the moving components of the compressor which would otherwise be caused by a shortness of the lubricating oil.

Obviously, many modifications and variations of the present invention are possible in the light of the above teachings. It is therefore to be understood that within the scope of the appended claims, the invention may be practiced otherwise than as specifically described.

We claim as our invention:

1. A sliding-vane rotary compressor, comprising:

(a) a cylinder head defining a portion of a low pressure chamber, and having a portion defining an intake passage for a fluid to be compressed; and (b) an intake pressure control valve disposed between said intake passage and said low pressure chamber for controlling the flow of the fluid into said low pressure chamber through said intake passage and including (1) a pressure responsive element actuatable in response to one of the pressure in said intake passage and the pressure in said low pressure chamber, (2) a pilot valve connected to said pressure responsive element for movement in unison with said pressure responsive element, (3) first means, defining a pilot passage adapted to be opened and closed by said pilot valve, for developing a difference in pressure, and at least one orifice through which said intake passage communicates with said low pressure chamber, (4) a main piston movable in response to said pressure difference, and (5) second means, responsive to the movement of said main piston, for varying the area of said orifice.

2. A sliding-vane rotary compressor according to claim 1, wherein said pressure responsive element comprises a bellows.

3. A sliding-vane rotary compressor according to claim 1, wherein said pressure responsive element comprises a diaphragm.

4. A sliding-vane rotary compressor according to claim 1, wherein said first means comprises a casing, said main piston being slidably disposed in said casing so as to define therebetween a valve chamber and having a throttle passage through which said intake passage permanently communicates with said valve chamber, said valve chamber being adapted to communicate with said low pressure chamber when said pilot passage is open.

5. A sliding-vane rotary compressor according to claim 4, wherein said casing has a cup-like configuration, said pilot passage being defined in a closed end of said cup-like casing, said orifice being defined adjacent to an open end of said cup-like casing, said main piston having a cup-like configuration, there being defined between said casing and said main piston a further valve chamber on the side which is opposite to said valve chamber, said pressure responsive element being disposed in said further valve chamber, said pilot valve extending between said valve chamber and said further valve chamber across a closed end of said cup-like main piston, said second means including an open end of said cup-like main piston.

6. A sliding-vane rotary compressor according to claim 4, wherein said casing has a cup-like configuration having a closed end and an open end opposite said closed end, said intake pressure control valve further comprising a peripheral flange, said pilot passage being defined in said closed end, said orifice being defined adjacent to said open end of said cup-like casing, said main piston having a cup-like configuration, further including a cover secured to said flange so as to define a further valve chamber between said cover and said closed end and at least one opening through which said low pressure chamber communicates with said further valve chamber, said pressure responsive element being disposed in said further valve chamber, said second means including a check valve slidably disposed in said casing and urged against said main piston, said check valve being adapted to be actuated by said piston to move in a direction to reduce the area of said orifice.

7. A sliding-vane rotary compressor according to claim 6, said pressure responsive element comprising a diaphragm having a peripheral edge portion secured between said flange and said cover so as to subdivide said further chamber into a reference pressure chamber and an actual pressure chamber, said opening communicating with said actual pressure chamber.

* * * * *